US005267520A

United States Patent [19]

Ingram

[11] Patent Number: 5,267,520

[45] Date of Patent: Dec. 7, 1993

[54] FABRIC PRODUCED BY HOLLOW NEEDLE TUFTING APPARATUS

[75] Inventor: Gary L. Ingram, Ooltewah, Tenn.

[73] Assignee: Tapistron International, Inc., Ringgold, Ga.

[21] Appl. No.: 1,186

[22] Filed: Jan. 7, 1993

Related U.S. Application Data

[62] Division of Ser. No. 836,835, Apr. 6, 1992, Pat. No. 5,205,233.

[51] Int. Cl.[5] ..... D05C 17/02

[52] U.S. Cl. ..... 112/410

[58] Field of Search ..... 112/410, 411, 266.2, 112/80.01, 80.31, 80.41, 80.32, 401, 405; 428/85, 92, 93; 156/72

[56] References Cited

U.S. PATENT DOCUMENTS 4,119,049 10/1978 Puckett ..... 112/266.2

*Primary Examiner*—Clifford D. Crowder
*Assistant Examiner*—Paul C. Lewis
*Attorney, Agent, or Firm*—Alan Ruderman

[57] ABSTRACT

A method for producing tufted fabric in a hollow needle tufting machine having transversely spaced apart needles including apparatus for shifting a backing material into which the tufts are inserted by the needles. The backing material is fed continuously in the feed direction longitudinally through the machine and is fed a number of steps laterally between adjacent needles and penetrated by the needles after each shift. The sequencing of the shifting and the feeding of the backing is such as to provide a row of tufts in the backing material along a line inclined relative to the direction the backing material is fed to the machine. The nominal number of tufts inserted between lateral ends of each row of tufts is equal to the spacing between adjacent needles divided by the selected stitch gauge. The sequencing of the shifting is such that certain rows of tufts have a number of tufts equal to the nominal number while alternate rows have more than the nominal number of tufts so that the lines of tufts have ends transversely offset relative to the adjacent lines of tufts. The sequencing additionally is such that the rows of tufts produced by each needle forms a chevron pattern which is repeated periodically. In this manner streak lines between adjacent needles are substantially eliminated.

2 Claims, 2 Drawing Sheets

FABRIC PRODUCED BY HOLLOW NEEDLE TUFTING APPARATUS

This application is a division of application Ser. No. 07/836,835, filed Apr. 6, 1992 now U.S. Pat. No. 5,205,233.

BACKGROUND OF THE INVENTION

This invention relates generally to tufting apparatus for producing patterned textile goods such as carpet, upholstery, and the like, and more particularly to tufting apparatus having a fabric shifting apparatus for moving backing material transversely between pairs of spaced apart hollow needles to which a plurality of yarns are selectively fed, the backing material being shifted in a sequence which precludes a visible line of demarcation in the product at the interface of stitches produced by adjacent needles.

U.S. Pat. No. 4,549,496 which issued Oct. 29, 1985, to Kile discloses highly advantageous tufting apparatus for producing patterned tufted goods using yarns of different colors or different textures. This apparatus is capable of placing yarn into a backing to create patterns and designs which previously were generally available only from a weaving loom or by using printing techniques. The patented apparatus employs multiple heads spaced across the width of a backing material. Each head comprises a reciprocating hollow needle or backing opener tube for penetrating the backing and for implanting yarn tufts in the backing by feeding yarn through the needle pneumatically. The needle is connected to a yarn exchanger into which a plurality of yarns of different colors, for example, are supplied, and a mechanism is included which enables the selection of one or more of the yarns for implantation into the backing for each penetration by the needle. The multiple heads are stepped in synchronism across the backing for a distance corresponding to the spacing between the heads in order to implant a transverse row of yarn tufts. The backing is then advanced to the position of the next row and the process is repeated to implant the next row. A computer controls the selection of the yarn implanted by each backing opener for each penetration of the backing in order to produce a desired pattern in the finished goods.

A significant factor influencing the production speed of practical apparatus embodying the invention of the Kile patent is the number of tufting heads embodied in the apparatus. The greater the number of heads, the less distance each head must traverse and, accordingly, the faster a row of tufts can be implanted in the backing. As the number of heads increases, however, other problems arise. The increased weight makes it more difficult to move the heads accurately and to maintain their alignment and positions relative to one another. Thus rather than the multiple heads which carry the hollow needles being moved across the backing, Ingram U.S. Pat. No. 4,991,523 discloses the backing rather than the heads being shifted transversely to move substantially less weight transversely. This not only simplifies the transverse shifting apparatus but also provides greater speed and accuracy to the yarn placement.

The shifting of the backing material results in a number of transversely spaced stitches produced by each needle, the spacing between adjacent stitches or tufts being equal to the stitch gauge of the product produced. For example, if the needles are spaced apart by two inches and the gauge or space between adjacent stitches is 1/10 inch, the backing is shifted a total of 20 steps from the first penetration of the backing by a particular needle to the last penetration of the backing by that needle before the fabric is shifted in the opposite direction. It was proposed in the prior art apparatus such as that disclosed in the aforesaid Ingram U.S. patent, to shift the backing the required number of steps laterally or transversely while the backing was stationary in the longitudinal or feed direction through the machine. That is, while the lateral shifting steps were made there was no feeding of the backing by the feed rollers through the machine, the feeding only occurring after the last stitch was made by each needle in a particular lateral row. The fabric was thereafter fed one forward move and then shifted a plurality of moves laterally in the opposite direction, a penetration occurring after each lateral shift. Thereafter the fabric was fed one forward move and shifted in the original lateral direction a plurality of moves.

With this shifting sequence the joint or interface between stitches made by adjacent needles is visible. The joint between adjacent needles is particularly apparent in a product where a pattern is produced in a plain or solid background at such interface. In that case a line readily can be seen at the interface and this detracts from the aesthetics of the product.

SUMMARY OF THE INVENTION

Consequently, it is a primary object of the present invention to provide for a hollow needle tufting machine a method of shifting a fabric a number of steps between adjacent needles, first in one direction and then in the other, in a manner such that no discernible line of demarcation is apparent between tufts formed by the adjacent needles.

It is another object of the present invention to provide a hollow needle tufting machine having transversely spaced apart hollow needles and means for shifting backing material a plurality of steps between adjacent needles to insert a plurality of transversely spaced tufts in the material by each needle to produce a tufted fabric, and wherein the feed means for feeding the fabric through the machine and the means for shifting the backing material are sequenced such that the relative movement between each needle and the backing provides diagonal lines of tufts relative to the feed direction first in one direction and then in the other.

It is a further object of the present invention to provide a hollow needle tufting machine having transversely spaced apart hollow needles and means for shifting backing material a plurality of steps between adjacent needles to insert a plurality of transversely spaced tufts in the material by each needle to produce a tufted fabric, and wherein the relative movement between each needle and the backing is such that adjacent tufts made by each needle are spaced apart along a diagonal line relative to the direction the fabric is fed through the machine.

It is a still further object of the present invention to provide a method of producing a tufted fabric by means of a hollow needle tufting machine having transversely spaced apart needles including means for shifting a backing material a plurality of steps between adjacent needles to insert a plurality of transversely spaced tufts in the material by each needle, wherein the relative movement between each needle and the backing is such that adjacent tufts made by each needle are spaced apart along a diagonal line relative to the direction the fabric is fed through the machine, and the transverse ends of the diagonal lines are transversely spaced from the ends of adjacent diagonal lines so that each needle forms a chevron pattern of tufts periodically repeated.

Accordingly, the present invention provides a method for sequencing the transverse shifting of the backing material relative to each needle of a hollow needle tufting machine, the sequencing resulting in each needle inserting tufts along a diagonal line relative to the direction the backing is fed through the machine, the diagonal lines commencing at one end as the backing shifts in one direction and terminates at another end where the backing begins shifting in the opposite direction, the last tuft at each end of each diagonal line being transversely offset relative to the adjacent diagonal line which is formed as the backing moves in the same direction.

To this end the backing is shifted by drive means controlled such that the transverse movement is stopped each time a tuft is to be inserted and thereafter restarted while the backing continuously moves in the direction of feed, the number of tufts inserted into the backing by a single needle along each diagonal line is dependent upon the gauge of the product produced, i.e., the space between adjacent tufts in the transverse direction. The control of the drive means to effect a transverse shifting includes offsetting the tufts at the ends of each diagonal line of tufts as the backing reverses its transverse direction from one needle toward an adjacent needle. Thus, each needle forms a chevron pattern of tufts which is repeated periodically.

BRIEF DESCRIPTION OF THE DRAWINGS

The particular features and advantages of the invention as well as other objects will become apparent from the following description taken in connection with the accompanying drawings in which.

DESCRIPTION OF THE PREFERRED EMBODIMENT

As previously indicated, the present invention is particularly adapted for use with apparatus of the type disclosed in the previously references U.S. Pat. No. 4,991,523, the disclosure of which are incorporated by reference herein for producing tufted textile products, such as carpet, wall coverings or upholstery. Details of structure and operation of the improved tufting apparatus of the present invention which are not directly related to the present invention and which are not described herein may be found by reference to the aforesaid patents.

Figure 1:
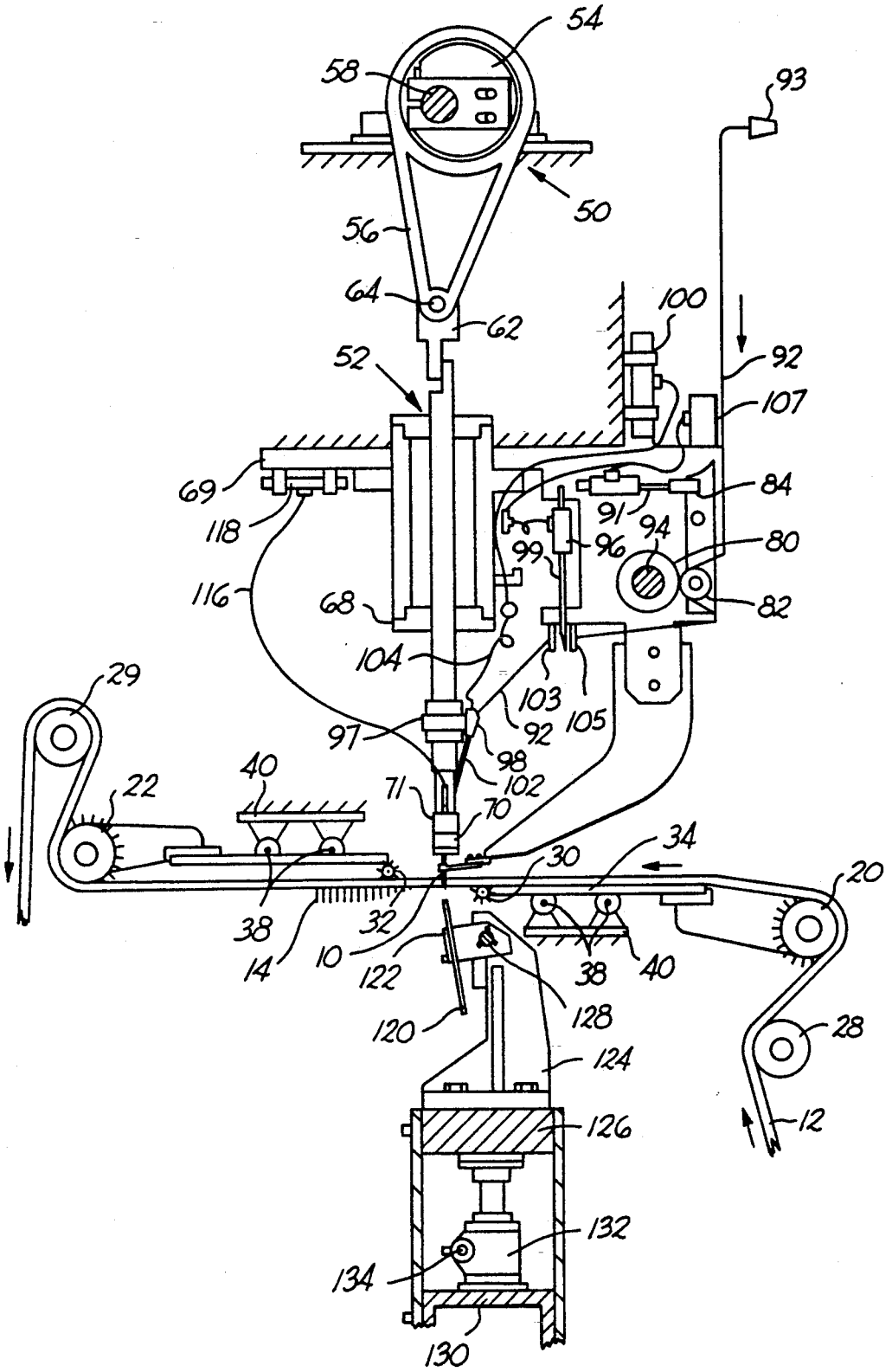
FIG. 1 is a side elevational view, partially in cross section and partially diagrammatic, of tufting apparatus embodying the invention.

The tufting apparatus of FIG. 1 comprises a plurality of reciprocating backing opener tubes or needles 10 (only one of which is illustrated) which, since they are hollow needles, are referred to as backing openers or needles for penetrating a primary backing 12 to implant yarn tufts 14 therein. The primary backing 12, which may be in the form of a continuous running web, for example, may be advanced longitudinally past the reciprocating needles (to the left in FIG. 1 as indicated by the arrow) by a backing advance or feeding system comprising a pair of pin rollers 20 and 22 which are driven by electric motors 24, 26 illustrated in FIG. 2, and hereinafter described, at slightly different rotational speeds so as to maintain the backing under tension as it passes the reciprocating needles. The backing advance system may further comprise a pair of guide rollers 28 and 29 which cooperate with the pin rollers 20 and 22, respectively, to guide the backing. As shown in the figure and for reasons which will be described in more detail shortly, a second pair of pin rollers 30 and 32, which may have smaller diameters than pin rollers 20 and 22, may be located closely adjacent to the reciprocating needles 10 on opposite sides of the backing. Pin rollers 30 and 32 provide better control of the backing in the area adjacent to where the tufts are implanted. As shown in the figure, pin roller 30 may be carried on a bed plate 34 at the lower side of the backing and be disposed adjacent to the location at which the needles penetrate the backing and pin roller 32 may be carried on a second plate 36 disposed at the upper side of the backing and located just downstream from the reciprocating needles. Plates 34 and 36 are transversely shiftable relative to the backing advance direction for reasons which will be described.

Figure 2:
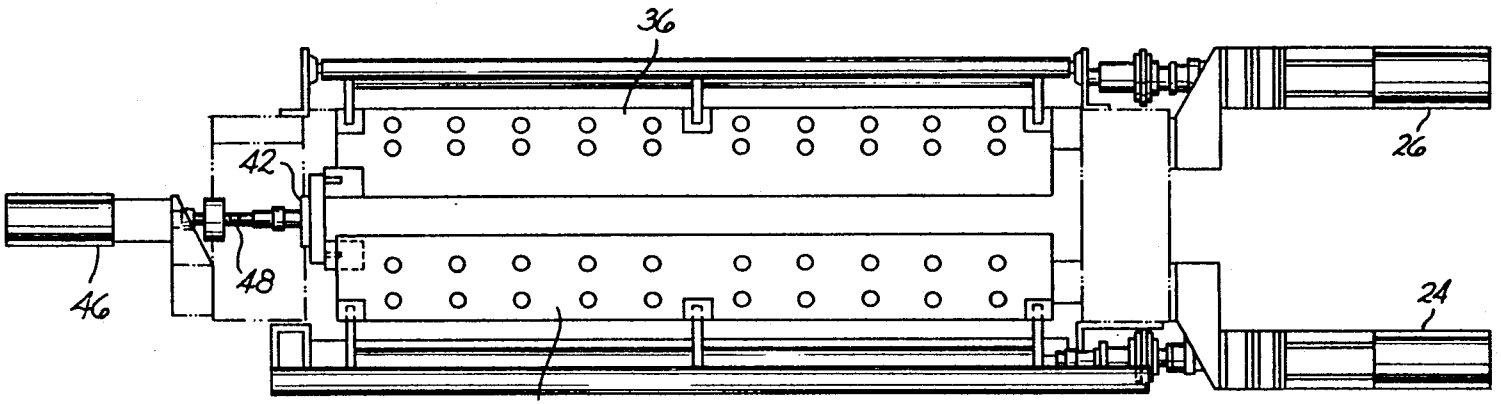
FIG. 2 is a top plan view of the fabric feed and shifting assembly of the apparatus illustrated in FIG. 1.

The pin rollers 20 and 22 preferably are also carried on the shiftable plates 34 and 36 respectively, as indicated in FIGS. 1 and 2. To enable transverse movement, i.e., movement laterally relative to the direction of backing material feed, each of the plates 34 and 36 may be carried on a pair of transversely extending shafts 38 which are supported by fixed portions 40 of the frame of the apparatus, shown diagrammatically, the plate 34 being slidable with the backing disposed thereon and the plate 36 being slidable with the backing on the underside. Plates 34 and 36 are preferably mechanically connected together by a structural member 42 illustrated in FIG. 2 and to a transverse positioning motor 46 which enables the plates 34, 36 as well as the pin rollers 20, 22 and their associated drive system to be shifted in unison transversely to the longitudinal direction of advancement of the backing. This produces a corresponding transverse shifting movement of the backing 12 so that each needle may insert yarn into the backing at a number of transverse locations. The transverse positioning mechanism preferably is a commercially available ball screw drive 48 capable of producing very small and precisely controlled transverse movements when rotated by the motor 46. This positioning mechanism, as hereinafter further described, enables precisely controlled movements of the order of a tenth of an inch or less. The rollers 28 and 29 may also be shifted transversely in substantial correspondence with pin rollers 20 and 22 by a second, less precise shifting mechanism.

The needles 10 may be reciprocated by one or more adjustable cam assemblies 50 which are coupled to the needles by a respective link assembly 52. The adjustable cam assembly may comprise a circular cam lobe member 54 rotatably supported by bearings within a circular portion of a yoke member 56. The cam lobe member is carried on and driven by a transversely extending rotating shaft 58 which is offset from the center of the cam lobe member preferably supported by bearings on a fixed portion 60 of the frame as shown. The link assembly 52 may comprise a coupling link or clevis 62 which is pivotably connected to a yoke member 56 as shown at 64 and connected to a vertically extending push rod 66 guided for vertical reciprocating movement by bushings or bearings 68 supported by other fixed portions 69 of the frame. The lower ends of the push rods 66 are connected to a mounting bar 71 which in turn carries the yarn exchangers 70, each yarn exchanger carrying a respective one of the needles 10. Upon rotation of shaft 58, cam members 54 rotate to impart reciprocating movement to yoke members 56 and, in turn, a similar movement to the needles via the link assembly to cause the needles to penetrate and withdraw from the backing repetitively.

The tufting apparatus of FIG. 1 also includes systems for supplying and controlling the yarn which is implanted into the backing. These systems include a yarn feed system for positively supplying a predetermined length of selected yarn to the yarn exchanger for each needle. The yarn feed system comprises a drive roller 80 which cooperates with a feed roller 82 carried on a movable member 84 which is pivotably supported on a journal member 86 on the frame portion 69, there being one roller 82 carried on a member 84 for each yarn supplied to each needle or backing tube opener 10. Each feed roller 82 may be urged into engagement with a respective drive roller 80, which may be a single roller for a number of feed rollers, by means of a respective pneumatic actuator 90 or the like which is connected to the pivotable member 84 by means of a rod 91 extendable and retractable from the actuator 90 so as to pivot the member 84 to urge the respective rollers 80 and 82 into contact with one another. Yarn 92 fed from a yarn supply such as a yarn cone 93 mounted on a creel (not illustrated) may be guided around the periphery of roller 82 so as to be between the engaging peripheral surfaces of rollers 80 and 82. The drive roller 80 may be supported on an icrementally rotated drive shaft 94 so that upon the shaft being rotated with the rollers 80 and 82 engaged, yarn is positively fed to the yarn exchanger 70 via a yarn pullback mechanism 96 and via a yarn ejector device 98. Thus, the yarn is trained so as to make a tortuous path about the roller 82 thereby resulting in a predetermined length of yarn being drawn from the yarn supply as the member 84 is pivoted to disengage the roller 82 from the roller 80. The yarn so drawn from the supply is thus ready for feeding toward the respective needle when the member 84 is again pivoted to engage the roller 82 with the roller 80.

The yarn pullback mechanism 96 for each needle includes a rod or plunger 99 having a passageway or eyelet which moves relative to a pair of yarn guides 103, 105 fixed to the frame, and the plunger 99 is disposed between the yarn guides 103,105. This mechanism acts to retract yarn from the needle 10 after a stitch has been formed and cut by the cutting apparatus hereinafter described and which is described in detail in U.S. Pat. No. 4,991,523, the yarn preferably being pulled into the yarn exchanger 70. One or more yarn ejector devices 98 associated with each needle is carried by an attachment bar 97 secured to the push rods. The ejector devices receive a plurality of different yarns (only one yarn 92 being illustrated in the drawings), each yarn having a separate passageway, along with pressurized air directed into each passageway from a pneumatic supply device 100. Preferably there is one ejector device for each needle, each device carrying six different yarns. For convenience adjacent needles have the respective ejectors mounted in staggered fashion so that one is on the front of the bar 97 and the next is on the rear of the bar, omitted in FIG. 1 for purposes of clarity. The supply device 100 supplies high pressure air to the passageway having yarn that has been selected for ejection into the needle or the backing tube opener and supplies low pressure air to the other passageways, the pressure selection being by pressure regulators and control means (not illustrated). Each yarn strand entering the ejector devices 98 is fed to the yarn exchanger 70 through a separate supply tube 102 which connects the ejector device to the yarn exchanger. A separate air line 104 for each yarn tube 102 is connected to the ejector device 98 to enable compressed air to be ejected into each yarn passageway in a controlled manner selectively to transport the selected yarn pneumatically under the higher pressure through the tube to the backing opener. The low pressure air supplied to the ejector 98 and thus the other air supply tubes ensure that the other yarns are available without delay after another respective yarn has been selected to be transported to the needle or backing tube opener. Additionally, the same or preferably, another pneumatic supply 107 may supply pressurized air to the actuator 90 and the pullback mechanism 96.

The yarn ejector devices 98, yarn supply tubes 102 and yarn exchanger 70 together function in a similar manner to the yarn exchanger described in U.S. Pat. No. 4,549,496 and operate in a similar manner. In the aforesaid patent, however, the yarn exchanger and the yarn ejection device were incorporated into a common unit while in the present apparatus the tubes 102 extend from the respective yarn ejector into corresponding passageway in the mounting bar 71, the passageways communicating with a funnel shaped interior (not illustrated) of the yarn exchanger 70. Thus, particular yarn may be selected for implantation into the backing by appropriately controlling the air supplied to the respective pneumatic actuator 90 to pivot the member 84 associated with the selected yarn so that the corresponding feed roller 82 is moved into engagement with the drive roller 80; by controlling the air supplied to the yarn pullback mechanism 96 to extend the plunger 99 and release the yarn previously drawn from the yarn supply; and by controlling the compressed air supplied by the supply 100 to the ejector devices 98 to transport the selected yarn to the yarn exchanger when the actuator 90 is actuated to extend the rod 91. Thus, the member 84 is pivoted to force the roller 82 against the roller 80 so that the yarn 92, which initially is the yarn held in reserve, is fed toward the respective needle or backing opener tube. Additionally, the plunger 99 is extended from the pullback mechanism 96 so that the eyelet or passageway therein is aligned with the guides 103, 105 to permit the yarn to be fed toward the needle, the extension of the rod 91 and the plunger 99, together with the change from low pressure to high pressure for the selected yarn passageway occurring substantially simultaneously. When the actuator 90 is controlled to retract the rod 91, the member 84 is pivoted to disengage the roller 82 from the roller 80 and terminate the feeding of the previously fed yarn. Also, the plunger 99 is retracted into the pullback mechanism to draw back yarn that has been fed but not used by the needle and held ready, as in a storage tank or plenum, until that yarn is again fed. The pullback mechanism 96 thus ensures that a previously fed yarn is drawn back into the vicinity of, and preferably into, the yarn exchanger 70 so that a blockage does not occur within the needle 10 which would restrict the feeding of the subsequently fed yarn. This permits substantially less air pressure to be required to feed the yarn from the yarn exchanger to the needle. A clamping means (not illustrated) between the pullback mechanism and the feed roller 82 ensures that yarn is drawn back from the needle rather than from the yarn supply, and to preclude any yarn from being drawn from the reserve resulting when the feed roller 82 is moved out of engagement with the drive roller 80, and also ensures that the extra yarn drawn by roller 82 when moving from roller 80 is available to be supplied to the needle.

As illustrated in FIG. 1, and as described in detail in the aforesaid U.S. Pat. No. 4,991,523, the tufting apparatus includes a cutting mechanism comprising a separate knife blade 120 for each needle. The blades are disposed on the opposite side of the backing from the needles and the needle reciprocating mechanism, as indicated in FIG. 1, and are arranged to cooperate with the needles by sliding over a respective angled surface which forms the pointed tip of the hollow needle in a shearing-like action to cut yarn that is ejected from the needles The knife blade 120 may comprise a flat elongated strip of metal, such as steel, which is held clamped in a knife block 122 disposed on a transversely spaced bracket 124 connected to a transversely extending frame member 126. The brackets 124 may be clamped tightly to a shaft 128 normally to hold the shaft stationary, and means may be provided to permit the shaft to be rotated to change the angle between the knife blade and the needle and to shift the knife blades transversely as necessary. Frame member 128 is preferably supported on a fixed member 130 of the apparatus frame by several screw-type jacks 132 (only one being shown) which are spaced transversely in the apparatus. The control shafts 134 of the jacks may be connected together by control rods so that the jacks may be lowered and raised in unison to adjust the positions of the knife blades relative to the backing.

Figure 3:
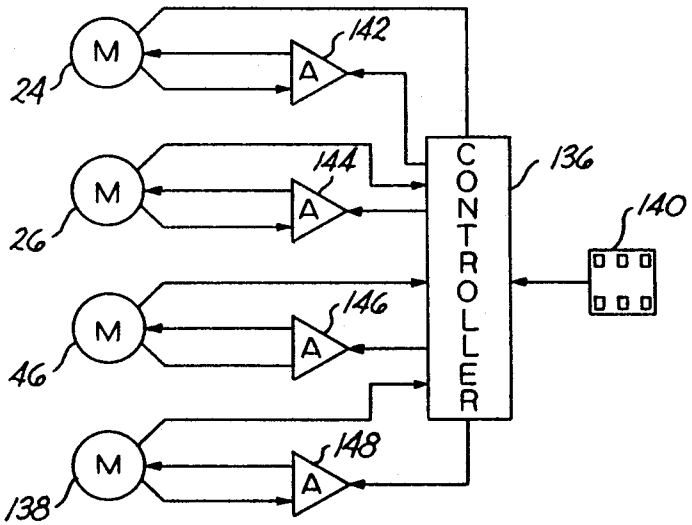
FIG. 3 is a diagrammatic view of the shifting and feed control system of the apparatus illustrated in FIG. 1.

The tufting apparatus in FIG. 1 employs a plurality of transversely stationary needles and preferably employs several adjustable cam assemblies 50 spaced transversely across the width of the backing and connected to shaft 58 to reciprocate the needles in synchronism to penetrate the backing. Each needle implants one or more selected yarns as determined by a controller 136 such as a computer, as illustrated in FIG. 3, which controls the yarn supply system and also the feed motors 24, 26 and the transverse positioning motor 46, together with the main motor 138 which drives the shaft 58. In order to implant a transverse row of tufts, the backing is shifted transversely in small increments corresponding to the spacing between adjacent tufts. By using a large number of needles spaced apart by relatively small spacings, e.g., 2.0 inches, the backing need be shifted transversely only by this rather small total distance in order to implant a complete transverse row of tufts. The number of shifts made within this total distance is equal to this distance divided by the stitch gauge, i.e., the spacing between adjacent stitches. For example, if the gauge is 0.1 inch, then there are 20 shifts or steps performed where the needles are spaced apart by 2.0 inches.

Because the position of each needle penetration is significant in relation to the pattern produced, the backing feed motors 24 and 26 and the transverse shifting motor 46 are reversible servo motors controlled by position relative to the position of the motor 138. The controller 136, which may be a Berkeley Motion Controller Model No. BAM-832 Hyperturbo manufactured by Berkeley Process Control, Inc. of Richland, Calif., is a programmable computer having a separate processor for each motor, the program being loaded from a host computer where the program is generated. A touch screen 140 is utilized to input variables such as stitch gauge and other pattern parameters. Programmed into the controller 136 are two master/slave tables. For each position of the mainshaft 58, i.e., the position of the main motor 138, in the first table there is provided a corresponding position for the transverse shifting motor 46 and in the second table for each position of the main motor there is a corresponding position for the rear pin roller drive motor 26, the first pin roller drive motor 24 being driven slightly slower than the motor 26 and in relation therewith so as to maintain tension on the backing 12. Thus, each motor receives signals from the controller 136 through a respective pulse width modulated amplifier 142, 144, 146, 148 and feeds its position back to the controller 136 to maintain the position prescribed by the master/slave tables.

Figure 4:
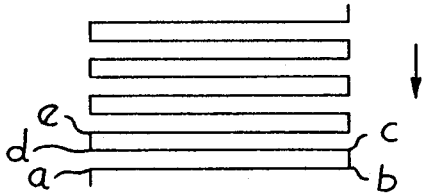
FIG. 4 is a diagrammatic view of the stitches or tufts formed by one needle according to the prior apparatus.

In the method initially proposed with the apparatus, as illustrated in FIG. 4, the backing 12 was held stationary in the feed direction while the transverse motor 46 shifted the plates 34 and 36 laterally in a first direction the required number of steps, one shift occurring after each needle penetrated the backing to provide a tuft. Thereafter the backing was fed by the motors 24, 26 one step equivalent to the stitch length and the backing was thereafter shifted in the reverse direction the same number of steps to form another row of tufts spaced from the first row. Thus, assuming a two inch spacing between adjacent needles and a stitch gauge of 0.1 inch, the backing was shifted transversely or laterally from a first stitch at point a 20 steps to point b while the backing was stationary in the feed direction illustrated by the arrow, a needle penetration occurring after each transverse shift. Thereafter, the backing was fed one step in the feed direction to point c where a needle penetration then occurred. The feed motors were then stopped so that the backing was again stationary in the feed direction and the transverse shifting motor was actuated in the opposite direction, a needle penetration occurring after each step, until the needle penetrated the backing at point d. The backing was then fed one step to point e and the process continued for the full length of the product.

As aforesaid, this shifting sequence provided a deficiency in that a line is visible at the interface between two stitches made by adjacent needles, especially in products where the interface is in the solid background of a patterned product. For example, the stitches at interface b-c and the other stitches produced due to the feed step such as at d-e can be seen as a streak in the product. The same is true in regard to each needle so that a series of streaks spaced, for example, two inches apart are readily visible.

Figure 5:
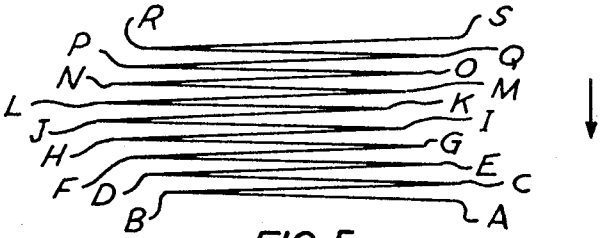
FIG. 5 is a view similar to FIG. 4, but illustrating the stitches or tufts formed by one needle according to the present invention.

To overcome this deficiency the present invention provides a unique shifting sequence, illustrated in FIG. 5. Accordingly, the backing material in the feed direction is not stopped but runs continuously although the backing material is stopped in the transverse direction during each needle penetration. The plates 34, 36 are driven a number of steps between points A and B equal to the spacing between adjacent needles divided by the lateral stitch gauge, this being the nominal number of steps. Thus, since the backing moves constantly in the feed direction, as illustrated by the arrow, the stitches or tufts formed between A and B are disposed along a diagonal line relative to the direction of feed. At the end of the line, e.g., point B, the transverse shifting motor reverses direction and the needle stitches a number of stitches as the backing continues to feed, there still being a lateral shift, a stop and a needle penetration as the fabric moves in the feed direction so that a second diagonal line is formed commencing a point B and continuing to point C. The number of stitches formed between point B and point C may be equal to the number of stitches between point A and point B, which is the nominal gauge, but commencing with the next series of stitches forming the diagonal line C-D the number of stitches inserted between points C and D is more than the nominal number inserted between A and B so that point D is offset transversely from point B. On the subsequent series of stitches as the backing is shifted in the reverse direction and the needle forms stitches along the diagonal D-E the number of stitches is again equal to the nominal number so that point E is offset from point C. This sequence of first forming the nominal number of stitches along one diagonal when moving transversely in one direction and thereafter a greater number than the nominal number of stitches along the adjacent diagonal when moving in the reverse direction is repeated for alternate diagonal rows of stitches so that point F is offset from point D and point E is offset from point C, etc. until the diagonal J-K is formed. Thus, each subsequent point B, D, F, H and F extends further to the left, as illustrated in FIG. 5, than the prior left-most point. The same is true with regard to the points C, E, G, I and K with respect to the right-most points. The line J-K provides laterally offset ends which are a preselected maximum distance relative to the ends B and C and B and A, which may be in the order of one-half inch. Thereafter the sequence reverses to form the mirror image, the diagonal K-L being the equivalent of J-K, diagonal L-M being the equivalent of I-J, etc. until the diagonal R-S which is equivalent to the diagonal C-D. If the end points B, D, F, H, J, L, N, P, and R are connected together by an imaginary line and the same occurs in regard to the end points A, C, E, G, I, K, M, 0, Q and S, the stitch sequencing can be seen to form a chevron pattern. Since each needle forms such a pattern the chevron is not apparent on the face of the fabric produced as each needle fills in the voids at the lateral ends made by the adjacent needles. Depending upon the stitch gauge, the extra stitches implanted in alternate diagonal lines may be one, two or three, the greater the gauge or number of stitches to be implanted between adjacent needles, the greater the number of extra stitches beyond the nominal.

With the aforesaid stitch sequence the interface between adjacent needles is varying with each transverse pass. Not only do the stitches along the diagonal lines act to break up the stitches occurring in the prior stitch sequencing method, but so does the offsetting of the stitch reversal points to the extent that the combination of these factors eliminates entirely any visible line of demarcation between stitches made by adjacent needles.

Numerous alterations of the structure herein disclosed will suggest themselves to those skilled in the art. However, it is to be understood that the present disclosure relates to the preferred embodiment of the invention which is for purposes of illustration only and not to be construed as a limitation of the invention. All such modifications which do not depart from the spirit of the invention are intended to be included within the scope of the appended claims.

Having thus set forth the nature of the invention, what is claimed herein is:

1. A tufted fabric comprising a plurality of tufts and backstitches disposed in respective rows defining a plurality of tuft lines, each line commencing with a first tuft at a first point and terminating with a second tuft spaced from said first point by a plurality of tufts and backstitches, said first and second points defining lateral ends of respective lines, each line of tufts and backstitches extending at an inclination to adjacent lines of tufts and backstitches and commencing at one of said first and second points common with said adjacent lines, the other of said first and second points being spaced from said adjacent lines, the number of tufts and backstitches in substantially all of said lines differing from the number of tufts and backstitches in adjacent lines and being equal to the number of tufts and backstitches in alternate lines.

2. A tufted fabric as recited in claim 1, wherein an imaginary line connected to the lateral end points at one lateral end of each tuft line and an imaginary line connected to the lateral end points at the other lateral end of each tuft line forms a chevron.

* * * * *